US009257047B2

(12) United States Patent
Bailey et al.

(10) Patent No.: US 9,257,047 B2
(45) Date of Patent: Feb. 9, 2016

(54) COMPUTATION OF NEW AIRCRAFT TRAJECTORY USING TIME FACTOR

(75) Inventors: Louis J. Bailey, Kent, WA (US); Marissa K. Singleton, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 1043 days.

(21) Appl. No.: 11/954,553

(22) Filed: Dec. 12, 2007

(65) Prior Publication Data

US 2009/0157288 A1 Jun. 18, 2009

(51) Int. Cl.
*G08G 5/00* (2006.01)

(52) U.S. Cl.
CPC ..... *G08G 5/0039* (2013.01)

(58) Field of Classification Search
CPC . G08G 5/0039; G08G 5/0013; G08G 5/0043; G08G 5/025; G08G 5/0082; G08G 5/045; G08G 5/0021; G08G 5/0008; G08G 5/0034; G08G 5/0056; G08G 5/00; G08G 5/0091; G01C 23/00; G01C 21/00; G01C 21/20; G01C 21/12; G01C 21/26; G01C 23/005
USPC ..... 701/120, 121, 122, 300, 301
See application file for complete search history.

(56) References Cited

U.S. PATENT DOCUMENTS

| | | | | |
|---|---|---|---|---|
| 3,875,379 | A | 4/1975 | Vietor | |
| 4,760,530 | A * | 7/1988 | Liden | 701/123 |
| 5,121,325 | A * | 6/1992 | DeJonge | 701/123 |
| 5,493,309 | A * | 2/1996 | Bjornholt | 342/455 |
| 5,842,142 | A * | 11/1998 | Murray et al. | 701/16 |
| 6,393,358 | B1 * | 5/2002 | Erzberger et al. | 701/120 |
| 6,463,383 | B1 * | 10/2002 | Baiada et al. | 701/120 |
| 6,507,782 | B1 * | 1/2003 | Rumbo et al. | 701/121 |
| 6,604,044 | B1 * | 8/2003 | Kirk | 701/120 |
| 7,437,225 | B1 * | 10/2008 | Rathinam | 701/14 |
| 7,623,960 | B2 * | 11/2009 | Wise et al. | 701/465 |
| 7,702,427 | B1 * | 4/2010 | Sridhar et al. | 701/4 |
| 7,756,632 | B2 * | 7/2010 | Wise et al. | 701/465 |
| 8,209,115 | B2 * | 6/2012 | Lucas et al. | 701/122 |
| 2003/0093219 | A1 * | 5/2003 | Schultz et al. | 701/202 |
| 2004/0078136 | A1 * | 4/2004 | Cornell et al. | 701/120 |
| 2004/0239550 | A1 * | 12/2004 | Daly, Jr. | 342/26 B |

(Continued)

FOREIGN PATENT DOCUMENTS

| | | |
|---|---|---|
| DE | 3126891 A1 | 1/1983 |
| DE | 4237530 A1 | 5/1994 |

OTHER PUBLICATIONS

Ostwald, Paul, "Impacts of ATC Related Maneuvers on Meeting a Required Time of Arrival," 25th Digital Avionics Systems Conference, Oct. 15, 2006.*

(Continued)

*Primary Examiner* — Truc M Do

(57) ABSTRACT

A time factor corresponding to an airspace delay or acceleration is communicated to an aircraft. A flight management computer or other computational device of the aircraft calculates a proposed change in trajectory in order to accommodate the time factor in an optimum or nearly optimum manner. One or more proposed changes in trajectory are subject to review by the pilot or other flight personnel. An operator-selected change in trajectory is then implemented in order to accommodate a new arrival time of the aircraft at its destination or a positional point.

16 Claims, 5 Drawing Sheets

(56) References Cited

U.S. PATENT DOCUMENTS

| | | | | |
|---|---|---|---|---|
| 2005/0192717 | A1* | 9/2005 | Tafs et al. | 701/3 |
| 2005/0283281 | A1* | 12/2005 | Hartmann et al. | 701/4 |
| 2006/0025898 | A1* | 2/2006 | Charles | 701/3 |
| 2007/0100538 | A1* | 5/2007 | Wise et al. | 701/200 |
| 2007/0129855 | A1* | 6/2007 | Coulmeau | 701/3 |
| 2007/0179703 | A1* | 8/2007 | Soussiel et al. | 701/200 |
| 2007/0219678 | A1 | 9/2007 | Coulmeau | |
| 2007/0219679 | A1* | 9/2007 | Coulmeau | 701/3 |
| 2008/0103646 | A1* | 5/2008 | Lucas et al. | 701/14 |
| 2008/0161982 | A1* | 7/2008 | Coulmeau et al. | 701/3 |
| 2008/0195264 | A1* | 8/2008 | Deker et al. | 701/7 |
| 2008/0195309 | A1* | 8/2008 | Prinzel, III et al. | 701/208 |
| 2008/0228333 | A1* | 9/2008 | De Menorval et al. | 701/14 |
| 2008/0300738 | A1* | 12/2008 | Coulmeau et al. | 701/3 |
| 2009/0037037 | A1* | 2/2009 | Mettes | 701/14 |

OTHER PUBLICATIONS

EP Search Report for Application No. EP08171586, dated Jul. 17, 2009, 6 pages.

Lent, et al., "Impact of Freeze Horizon on the Variation of Delay Distribution and Workload for En Route Metering," retrieved on Jul. 26, 2007, AIAA 4th Aviation Technology, Integration and Operations (ATIO) Forum Sep. 20-22, 2004, Chicago, Illinois.

Ostwald, "Impacts of ATC Related Maneuvers on Meeting a Required Time of Arrival," retrieved on Jul. 26, 2007, at <<http://www.mitre-corporation.net/work/tech_papers/tech_papers_07/06_1081/index.html>>, The MITRE Corporation.

* cited by examiner

| AIRCRAFT | ETA | DELAY | NEW ETA |
|---|---|---|---|
| 302A | 11:05 | 15 MIN | 11:20 |
| 302B | 11:09 | 16 MIN | 11:25 |
| 302C | 11:28 | 2 MIN | 11:30 |
| 302D | 12:20 | ZERO | AS-IS |

COMPUTATION OF NEW AIRCRAFT TRAJECTORY USING TIME FACTOR

FIELD OF THE DISCLOSURE

The field of the present disclosure relates to aircraft control, and more specifically, to controlling an aircraft so as to accommodate an air or ground traffic control time delay or acceleration time factor.

BACKGROUND OF THE DISCLOSURE

Presently, ground-based air traffic control (ATC) automation applications determine the airspace delay. Such an airspace delay typically manifests itself as a time-of-arrival at a destination later then originally planned for the aircraft. Any number of factors can contribute to such a delay including, for example, air traffic congestion, bad weather at the destination airport, emergency vehicle response at the destination, the need to accommodate an unscheduled landing of another aircraft, etc. Airspace delays are generally handled by relaying specific speed, altitude and/or directional changes from ATC to each affected aircraft in a frequently updated, multiple-instruction manner. In effect, ATC must "micro-manage" each aircraft subjected to the airspace delay.

Presently known ground-based airspace delay methodologies are not efficient in management of airspace delay. Additionally, ATC ground-based automation generally cannot account for specific weather being experienced by an aircraft, aircraft performance, cost of operation for a particular aircraft, etc. As a result, management of airspace delay is typically much less than optimal with respect to fuel consumption, air traffic congestion, situational awareness and overall flight safety. Furthermore, present airspace delay procedures are often not implemented for a given aircraft until it arrives at an airspace entry fix, resulting in limited response options. Therefore, improved airspace delay management would have great utility.

SUMMARY

Flight time factor methods in accordance with the teachings of the present disclosure can be used to accommodate (i.e., absorb) a delay or acceleration time factor in an optimum or near-optimum manner.

In one embodiment, a method includes communicating a time factor to a computational device of an aircraft. The method also includes calculating one or more proposed changes in trajectory in accordance with the time factor using the computational device. The method further includes altering the trajectory of the aircraft in accordance with a selected one of the one or more proposed changes in trajectory.

In another embodiment, a method of controlling an aircraft includes inputting a time factor to a computational device of the aircraft, the time factor originating at a ground-based control entity. The method also includes calculating one or more proposed changes in trajectory in accordance with the time factor using the device. The method further includes displaying the one or more proposed changes in trajectory to an operator of the aircraft. The method also includes altering flight of the aircraft in accordance with an operator selected one of the one or more proposed changes in trajectory.

In yet another embodiment, one or more computer-readable storage media include a program code. The program code is configured to cause a computer to receive a time factor. The program code is also configured to cause the computer to calculate a proposed change in trajectory in accordance with the time factor. The program code is farther configured to cause the computer to display the proposed change in trajectory to an operator of an aircraft.

The features, functions, and advantages that are discussed herein can be achieved independently in various embodiments of the present disclosure or may be combined various other embodiments, the further details of which can be seen with reference to the following description and drawings.

BRIEF DESCRIPTION OF THE DRAWINGS

Embodiments of systems and methods in accordance with the teachings of the present disclosure are described in detail below with reference to the following drawings.

DETAILED DESCRIPTION

The present disclosure introduces systems and methods for implementing a time factor in the flight of an aircraft. Many specific details of certain embodiments of the disclosure are set forth in the following description and in FIGS. 1-6 to provide a thorough understanding of such embodiments. One skilled in the art, however, will understand that the disclosure may have additional embodiments, or that the disclosure may be implemented without several of the details described in the following description.

Illustrative Operating Environment

Figure 1:
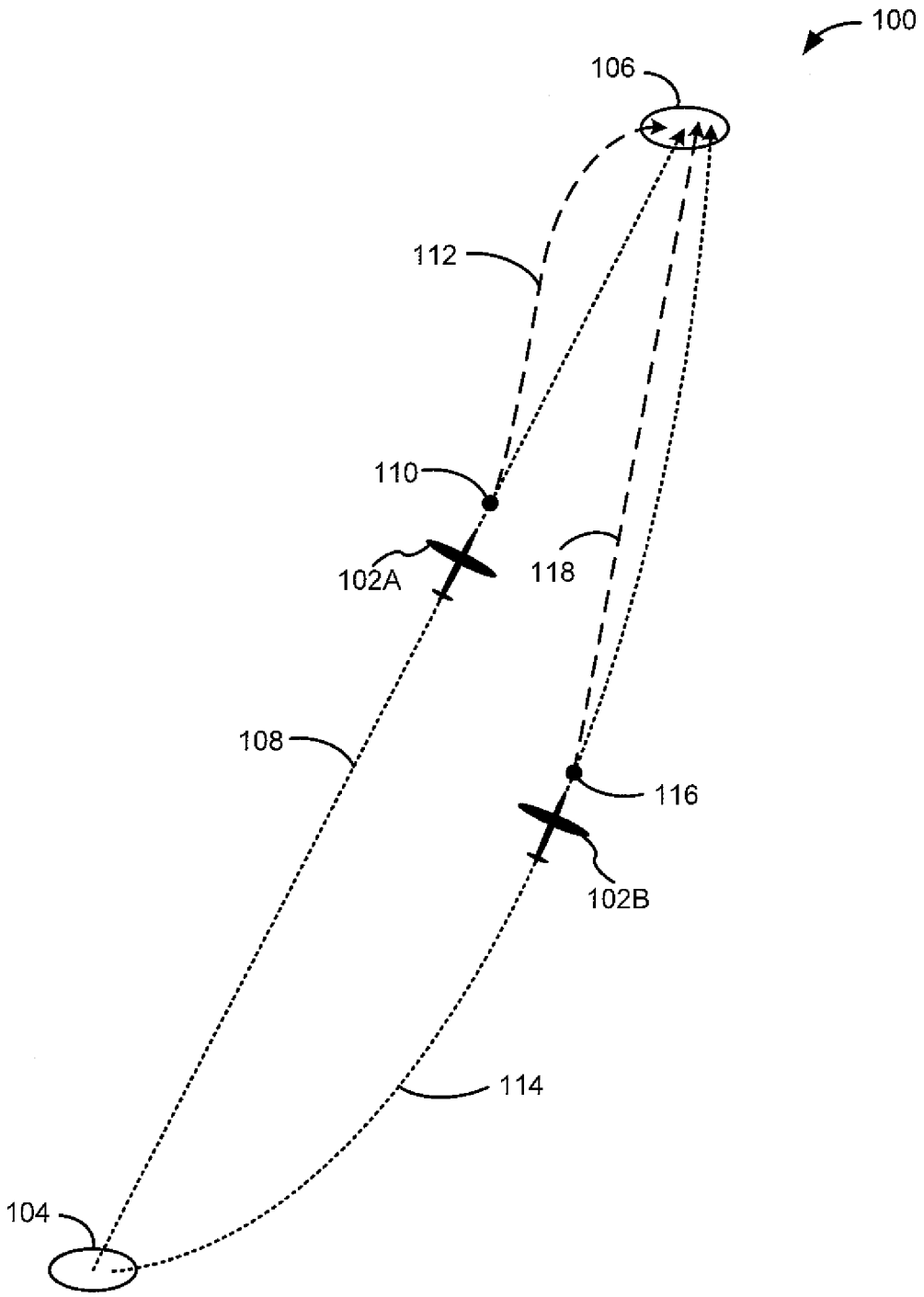
FIG. 1 is a diagrammatic plan view depicting illustrative operations in accordance with the present teachings.

FIG. 1 is a diagrammatic plan view depicting illustrative operations 100 in accordance with the present teachings. The illustrative operations of FIG. 1 are intended to aid in an understanding of the present teachings and are non-limiting in nature. FIG. 1 includes an aircraft 102A presumed to be in flight from an origin 104 to a destination 106.

In one illustrative situation, the aircraft 102A is in flight along a pre-planned flight path 108. As depicted, the flight path 108 is substantially direct to the destination 106 and the aircraft 102A is assumed to be flying at an optimum (or so) cruising speed and altitude for the greater portion of the trip. At some point along the path 108 between the origin 104 and the point 110, the operator of the aircraft 102A receives a delay factor from ground-based automation such as air traffic control (ATC) or other entities, for example, thirty minutes. That is, the operator has been instructed to delay their arrival at the destination 106 by thirty minutes over their originally scheduled arrival time.

The operator then uses the flight management computer (FMC) of the aircraft 102A to calculate an optimum (or nearly so) change in trajectory (i.e., flight) in order to accommodate the thirty minute delay. In another implementation, some other device (e.g., computer, dedicated purpose instrument, computational device, etc.) distinct from the FMC can be used to calculate an optimum change in trajectory. The operator reviews and accepts the proposed change in trajectory. Upon arrival at point 110, which may be immediately or at some time in the future, the aircraft implements the change in trajectory by diverting away from the original flight path 108 in order to travel along the flight path segment 112. In doing so, the aircraft 102A is able to maintain optimum cruising speed and altitude, while also absorbing the required thirty minute airspace delay.

In another illustrative scenario, also depicted in FIG. 1, another aircraft 102B is presumed flying along an original flight path 114. At some point along the path 114 prior to the point 116, the aircraft 102B operator receives instructions from ATC to accelerate their arrival time by fifteen minutes. That is, the operator is instructed to arrive at the destination 106 fifteen minutes earlier than originally scheduled. The operator then uses the FMC (or another suitable device) to calculate an optimum (or nearly so) change in trajectory in order to accommodate the airspace acceleration—a negative delay factor.

Once the operator accepts the computer-proposed change in trajectory, the aircraft 102B diverts (i.e., immediately or in the future) from the flight path 114 at the computer-specified point 116 along a flight path segment 118. This more direct path segment 118 enables the aircraft 102B to continue flying at optimal altitude and/or speed—or at a different, higher speed—while implementing the required fifteen minute acceleration in arrival time. Thus, FIG. 1 depicts but two of an essentially unlimited number of possible time factor optimization scenarios possible in accordance with the present teachings. In any case, the flight management computer (FMC) or other computational aid of the affected aircraft is used to determine an optimized change in trajectory, taking into account particular parameters and performance characteristics of the aircraft, present weather conditions, near-space air traffic, and other factors.

Illustrative Method

Figure 2:
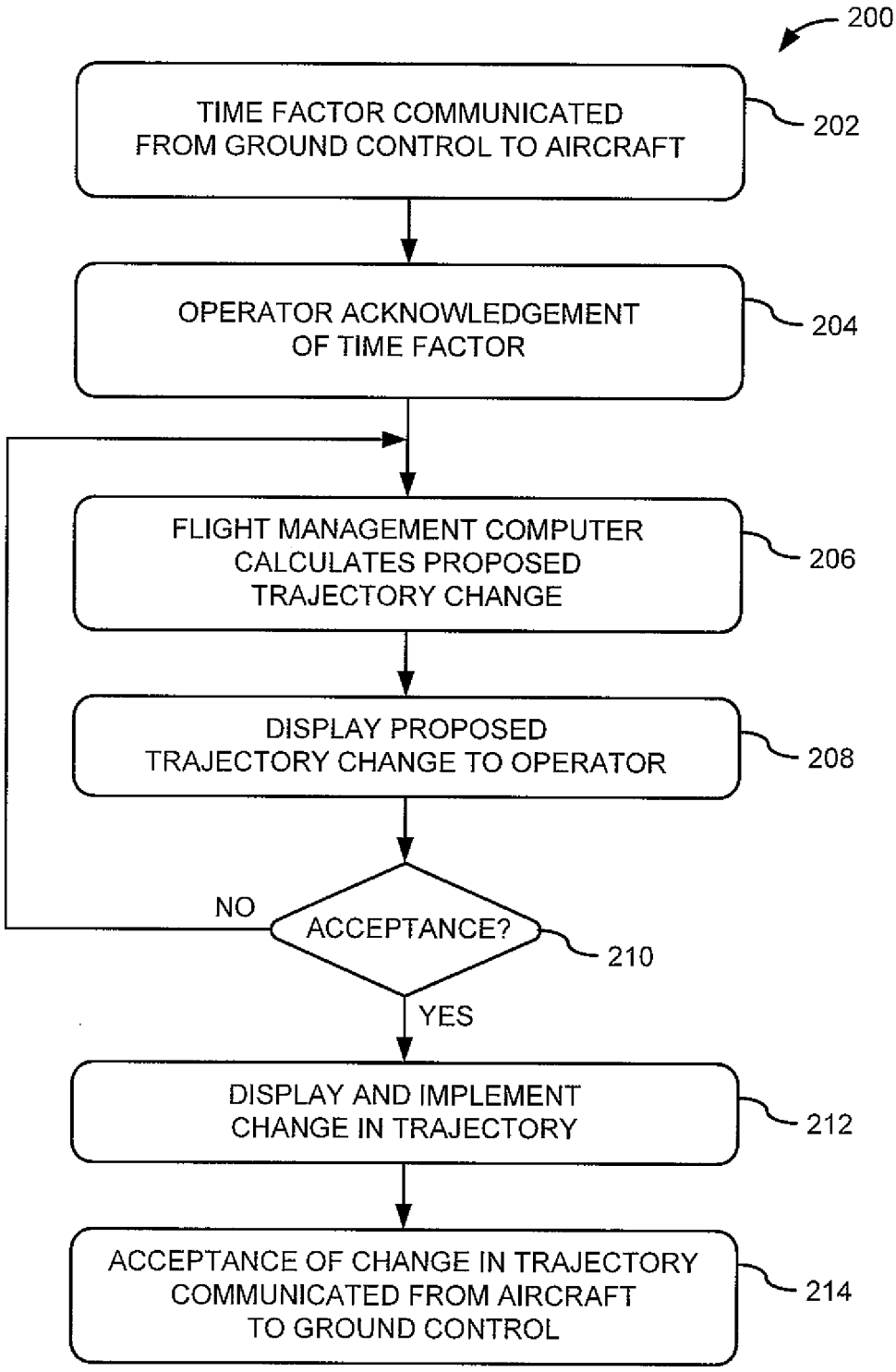
FIG. 2 is a flow diagram depicting a method of operation in accordance with one implementation.

FIG. 2 is a flow diagram 200 depicting a method in accordance with one implementation of the present teachings. The diagram 200 depicts particular method steps and order of execution. However, it is to be understood that other implementations can be used including other steps, omitting one or more depicted steps, and/or progressing in other orders of execution without departing from the scope of the present teachings.

At 202, a delay factor is communicated from a ground-based air traffic control (ATC) center to an aircraft in flight toward a destination. For purposes of non-limiting illustration, it is assumed that ATC communicates a delay factor of twenty-five minutes. Time factors, whether they are delay or acceleration factors, can be expressed and/or communicated in any suitable time units. Non-limiting examples of such units include whole minutes, minutes and seconds, minutes and tenths of minutes, whole and/or tenths of hours, etc. The communication of the delay factor (i.e., time factor) can be verbal in nature, with ATC personnel speaking directly to the operator of the aircraft. In another implementation, the delay factor is relayed to the aircraft by data link communication with the flight management computer (FMC). Other suitable ways of communicating the delay factor can also be used. While FIG. 2 depicts use of the FMC at 206, it is to be understood that another suitable device (computer, computational aid, etc.) can also be used.

At 204, the operator (which may be a pilot, other flight crew, or a remote operator) acknowledges the delay factor communicated from ATC. This acknowledgment can take any suitable form such as, for example, verbal communication with ATC, operator input to the FMC that is communicated by data link to ATC, etc.

At 206, the FMC (or other computational device) of the aircraft calculates a proposed trajectory change in order to accommodate the delay factor. The change in trajectory can include, as non-limiting examples, a change in airspeed, a change in altitude, a change in flight path, a change in flight path, a change in rate of climb and/or descent, or any combination of two or more of the foregoing or other flight characteristics. In another illustrative scenario, the delay factor is communicated to the aircraft prior to departure such that the proposed change in trajectory includes a change in takeoff time (e.g., more or less wait time on the ground). Other suitable flight characteristics can also be altered in accordance with the proposed change in trajectory.

At 208, the FMC (or other device) displays the proposed change in trajectory to the operator. The display can include a graphical representation of the proposed change in flight path, alphanumeric data corresponding to a proposed change in speed and/or altitude, etc. Any suitable display content can be used to relay the proposed change in trajectory to the operator (including other flight personnel).

At 210, the operator (or designee) either accepts or rejects the proposed change in trajectory calculated at 206 above. If the proposed change is accepted, then the method continues at 212 below. If the proposed change is rejected, then the method returns to 206 above and the FMC (or other computational device) calculates a new proposed change in trajectory. In this way, the operator can reject one or more distinctly differently proposed changes in trajectory prior to selecting a particular change to be implemented. This operator selection aspect allows human judgment to be applied in accordance with factors that may not have been considered by the FMC (or other computer, etc.) such as, for example, avoiding an undesirable cruising altitude due to turbulence, etc.

At 212, the selected change in trajectory (i.e., flight characteristics) is displayed, in whole or in part, to the operator and is implemented by way of automated control, manual control, or some combination of automated and manual control. In one implementation, automatic engine thrust and/or control surface positioning is performed, at least in part, during the change in trajectory. Automated control to one extent or another can also be performed by way of other implementations.

At 214, the accepted (i.e., selected) trajectory change is communicated from the aircraft to origin of the time delay factor. As needed, ATC may acknowledge the selected trajectory change and/or communicate other information to the aircraft. In the event that relevant conditions change at the destination or near airspace, other delay or acceleration factors may be communicated to the aircraft, requiring additional iterations of the method 200. In any case, the FMC (or another suitable device or computational entity) of the aircraft is the primary resource used to determine an optimum or near-optimum response to a required change in flight time. In one or more instances, optimization can be based on the economical operation of the aircraft. Other optimization criteria (e.g., foul weather avoidance, etc.) can also be used.

Illustrative Operating Scenario

Figure 3:
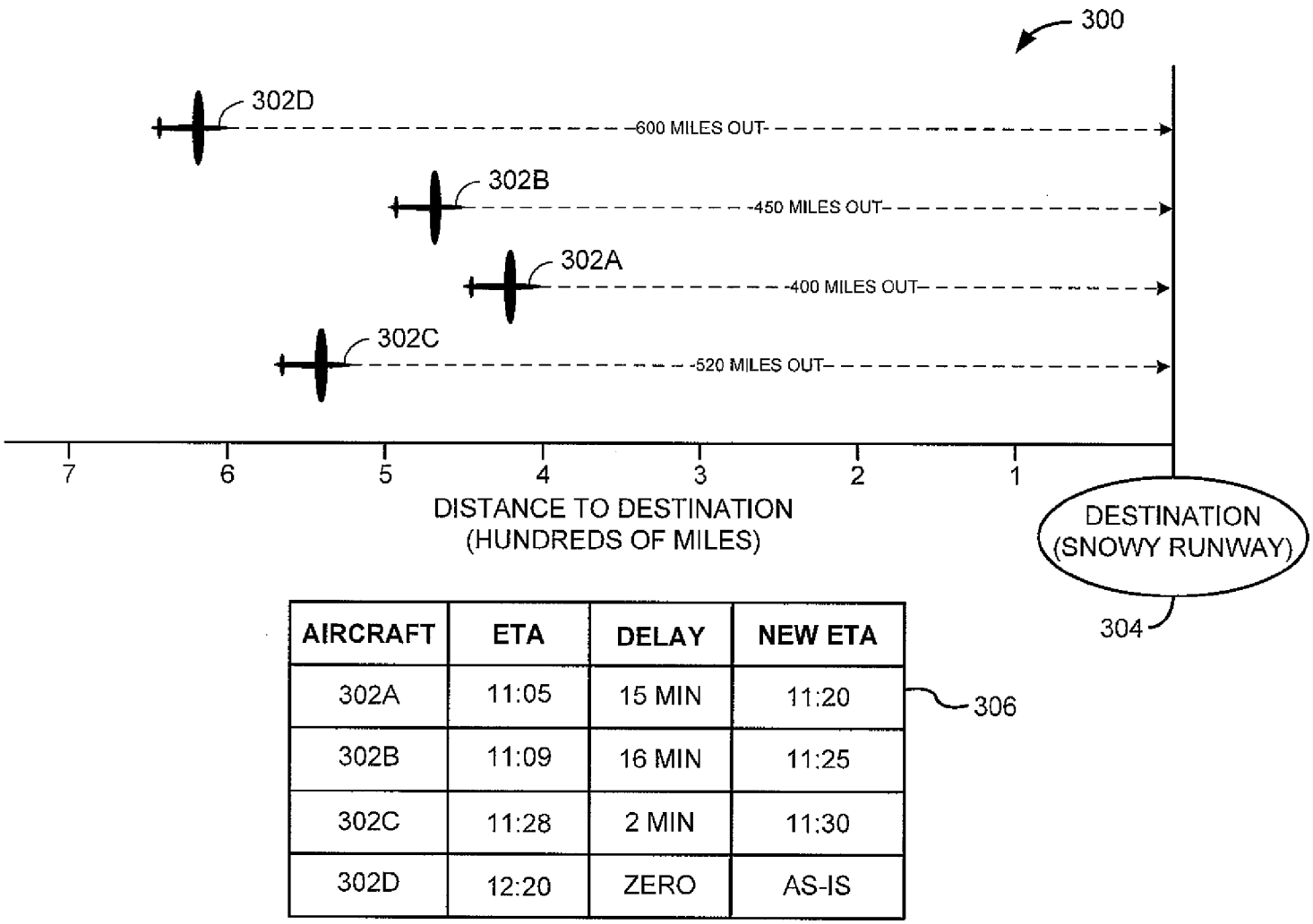
FIG. 3 is diagrammatic view depicting an illustrative implementation of the method of FIG. 2.

FIG. 3 is a diagrammatic view depicting an operational scenario 300 in accordance with the present teachings. The operational scenario 300 is illustrative and non-limiting in nature, and is presented to aid in understanding the application of the present teachings in a multi-aircraft situation. It is to be understood that the present teachings are applicable to other scenarios involving any practical number of affected aircraft.

The scenario 300 includes four aircraft 302A, 302B, 302C and 302D, respectively. Each of the aircraft 302A-302-D, inclusive, is understood to be in flight toward a common destination (i.e., airport) 304. It is further understood that the destination 304 is presently experiencing some condition that impedes or prevents normal aircraft landing procedures such as, for example, a runway covered in snow. Thus, under the present example, additional time is needed for ground support personnel to plow the runway and/or perform other tasks at destination 304 in the interest of providing safer landing conditions.

In response to the need for additional work time, ground control (i.e., ATC) at destination 304 determines that the earliest safe arrival time for an aircraft is 11:20 local time. ATC then reviews the original (i.e. present) estimated time of arrival (ETA) for each of the inbound aircraft 302A-302D. Table 306 of FIG. 3 depicts this information. ATC then determines a delay factor for each of the aircraft 302A-302D in order to assure that: i) the earliest flight arrival is not before 11:20 local time; and ii) the flights maintain separation assurance with an additional margin of safety under current weather conditions.

ATC then communicates delay factors of 15 minutes, 16 minutes, 2 minutes, and none to the aircraft 302A, 302B, 302C and 302D, respectively. That is, aircraft 302D need not, at least presently, alter its original flight plan in order to accommodate conditions at the destination 304. Each of the respective delays is also depicted in table 306 of FIG. 3, as are the new ETA's for each aircraft. Each of the operators responsible for aircraft 302A-302D acknowledges the respective delay factor. The flight management computer (FMC), or another respective device, of each aircraft (other than 302D) is then used to calculate an optimum change in trajectory in order to accommodate the respective delay.

The operator reviews and selects an acceptable change in trajectory as calculated and displayed aboard that particular aircraft 302A-302C. The respective changes are then implemented so as adjust the arrival time of the respective aircraft 302A-302C to its new ETA. The change in trajectory for each aircraft can include any one or more changes in flight parameters such as, for example, a change (i.e., reduction) in airspeed, a change in flight path, a change in cruising altitude, etc. These and/or other aspects of flight can also be appropriately altered in order to accommodate the respective delay factor. In any case, each of the aircraft 302A-302C employs methodology (e.g., the method 200, etc.) consistent with the present teachings.

Thus far, the present teachings have been described, predominately, in the context of delay factors—that is, aircraft required to make flight adjustments in order to arrive at its/their destination later than originally scheduled. However, the present teachings also anticipate acceleration factors, wherein one or more aircraft are instructed by ATC to arrive earlier at a destination or positional point then originally scheduled (if possible). Such an acceleration factor can be accommodated by, for example, an increase in airspeed, a decrease in cruising altitude (thus reducing the overall flight path), change in rate of descent, etc. Other changes in flight parameters can also be used to accommodate an acceleration factor. Thus, either a delay factor or an acceleration factor can be referred to as a time factor.

Illustrative Computer Displays

Figure 4:
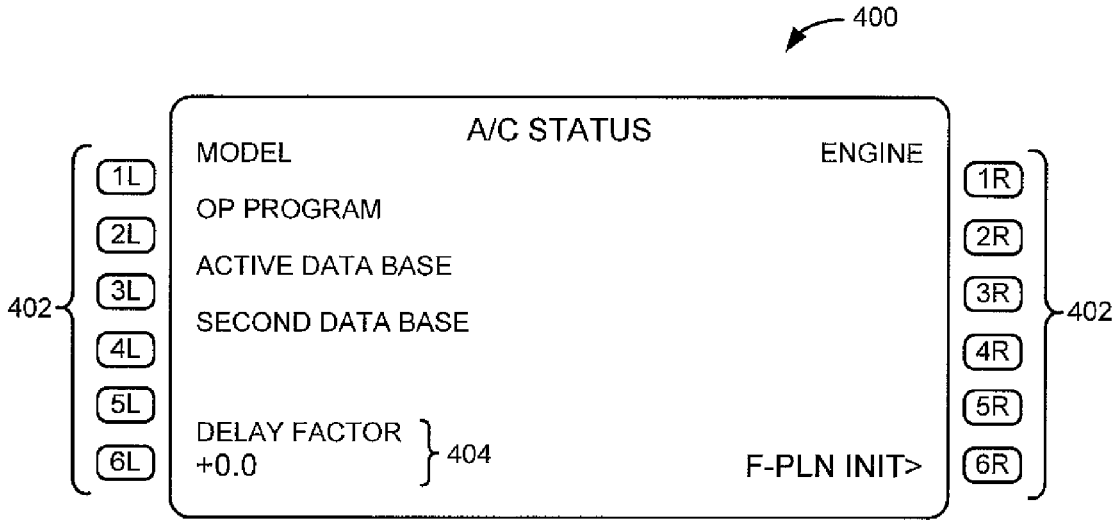
FIG. 4 is an elevation view depicting a computer display in accordance with one implementation.

FIG. 4 is a display 400 in accordance with an implementation of the present teachings. The display 400 is illustrative and non-limiting in nature. The display 400 includes operator interface buttons 402, as well as alphanumeric content not relevant to an understanding of the present teachings. One having ordinary skill in the aeronautical control arts will appreciate that the display 400 includes at least some features that are known. The display 400 further includes alphanumeric content 404 corresponding to a delay factor that has been or can be entered into an FMC, or similar trajectory computer, of or for an aircraft. In one implementation, one or more of the user input buttons 402 can be used to select and/or adjust the delay factor for purposes of calculating a proposed change in trajectory.

Figure 5:
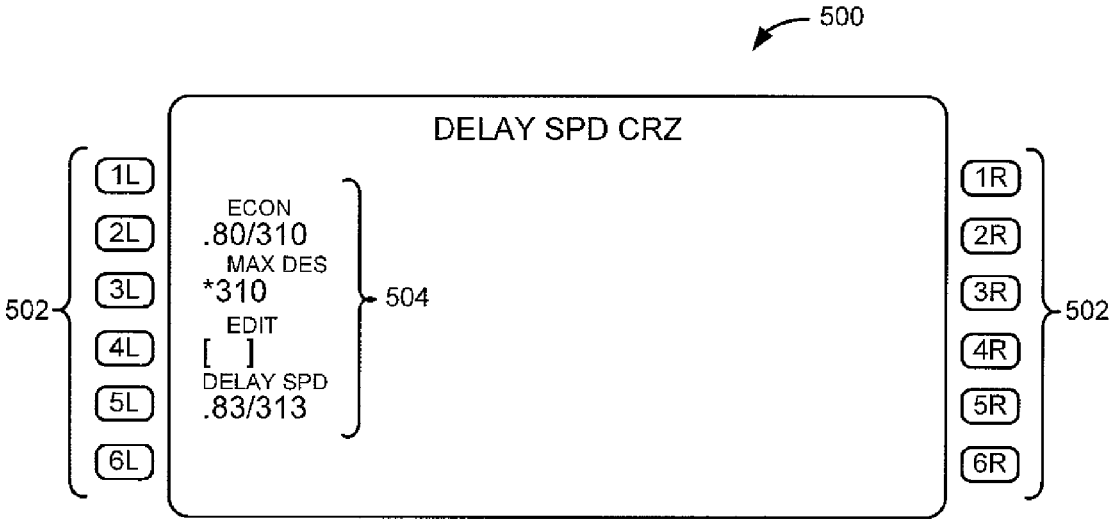
FIG. 5 is an elevation view depicting a computer display in accordance with another implementation.

FIG. 5 is a display 500 in accordance with another implementation of the present teachings. The display 500 is illustrative and non-limiting in nature. The display 500 includes operator interface buttons 502. The display 500 also includes alphanumeric content 504 corresponding to proposed and/or implemented changes in trajectory so as to accommodate a delay factor. As depicted in FIG. 5, the airspeed of the associated aircraft has been adjusted to absorb the respective delay.

Illustrative Aircraft

Figure 6:
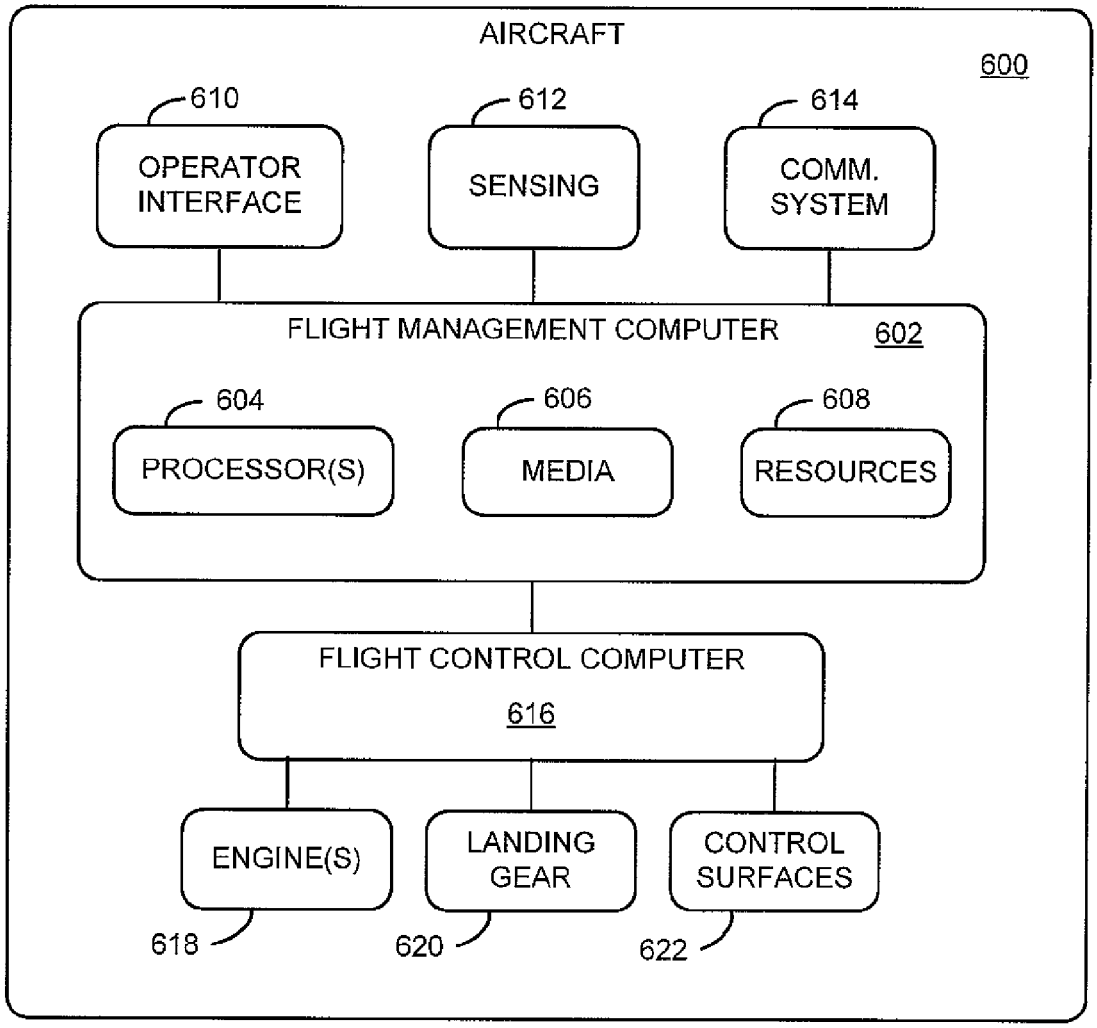
FIG. 6 is a block diagrammatic view depicting an aircraft 600 in accordance with one implementation.

FIG. 6 is a block diagrammatic view depicting an aircraft 600 in accordance with one implementation. The aircraft 600 is illustrative and non-limiting in nature. The aircraft 600 includes only particular features and elements, and omits any number of other features and elements, in the interest of clear understanding of the present teachings. A person of ordinary skill in the relevant art can appreciate that other aircraft (not shown), having any number and/or combination of features and elements, can also be defined and used in accordance with the present teachings.

The aircraft 600 includes a flight management computer (FMC) 602. The FMC includes one or more processors 604, and media 606. The media 606 can be defined by one or more computer-readable storage media (collectively) including a program code configured to cause the one or more processors 604 to perform particular method steps of the present teachings (e.g., particular steps of the method 200, etc.). Non-limiting examples of such media 606 include one or more optical storage media, magnetic storage media, volatile and/or non-volatile solid-state memory devices, RAM, ROM, PROM, etc. Other suitable forms of media 606 can also be used. The FMC 602 further includes other resources 608 as needed and/or desired to perform various operations. The precise identity and extent of these resources 608 is not crucial to an understanding of the present teachings and further elaboration is omitted in the interest of clarity.

The aircraft 600 also includes an operator interface coupled to the FMC 602 either directly or remotely. The operator interface 610 can include, for example, one or more electronic displays, any number of pushbuttons or other input devices, a heads-up display, various analog and/or digital display instruments, etc. In short, the operator interface 610 can be comprised of any suitable combination of features and resources.

The aircraft 600 also includes sensing resources 612. Sensing resources 612 can include radar, atmospheric sensing instrumentation, satellite positioning sensors, and/or other features as needed or desired. The sensing resources 612 are coupled in communication with the FMC 602 so as to provide information necessary to navigation and/or other aspects of aircraft 600 operation. Sensed information can include, for example, detection of other aircraft in near-airspace so as to safely account for their presence when calculating a proposed change in trajectory. The aircraft 600 also includes a communications system 614. The communications system 614 can include single or multi-band radio transceiver equipment, satellite communications capabilities, etc. As depicted in FIG. 6, the communications system 614 is coupled to the FMC 602 such that data link communications with ATC or other entities is possible. Other configurations of communications equipment can also be used.

The aircraft 600 further includes a flight control computer (FCC) 616. The FCC 616 is configured to interface with, and accept commands from, the FMC 602. In turn, the FCC 616 is configured to manipulate (i.e., controllably influence) one or more engines 618, landing gear 620, and control surfaces 622 of the aircraft 600. Thus, as depicted in FIG. 6, the engine(s) 618, landing gear 620 and control surfaces 622 can be monitored and/or controlled (indirectly), to various respective degrees, by the FMC 602 by way of the FCC 616. As depicted in the present example, the FMC 602 is (indirectly) capable of automatically controlling one or more phases of flight, to a least some extent. Thus, the FMC 602 is capable of at least partially implementing a flight (i.e., trajectory) change in accordance with a time factor by way of automated control.

In another implementation (not shown), the FMC does not provide for automated flight control (i.e., automatic subsystem manipulation) and performs only computational and informational tasks. In yet another implementation (not shown), the FMC and/or the FCC is omitted, and/or one or more other computational devices (not shown) are included, etc. Other aircraft implementations having any of the foregoing and/or other resources can also be defined and used in accordance with the present teachings.

Additional Comments

Controlling aircraft trajectories to time tends to increase predictability and airspace capacity, aids the operator and ground control in situational awareness, and saves fuel. In place of continually adjusting aircraft speeds or other flight parameters based on controller-to-aircraft instructions, respective time factors can be partitioned among several aircraft so as to accommodate an overall airspace delay. The flight management computer, or similar like trajectory computer, of each affected aircraft can then optimize its path or other flight characteristics accordingly, adjusting speed or suggesting routes to the operator to absorb the specified delay.

While specific embodiments of the disclosure have been illustrated and described herein, as noted above, many changes can be made without departing from the spirit and scope of the disclosure. Accordingly, the scope of the disclosure should not be limited by the disclosure of the specific embodiments set forth above. Instead, the scope of the disclosure should be determined entirely by reference to the claims that follow.

What is claimed is:

1. A method for an aircraft having a flight management system (FMS), the method comprising:

receiving at least one assigned time factor from a ground based entity as the aircraft is flying towards a destination, the at least one assigned time factor imposing an arrival constraint at the destination;

using the FMS to compute a plurality of new trajectories from a current location of the aircraft to the destination, the new trajectories computed in accordance with corresponding new time factors that satisfy the arrival constraint; and selecting one of the new trajectories based on flight and customer parameters and performance characteristics of the aircraft.

2. The method of claim 1, wherein computing each new trajectory includes modification of waypoint information.

3. The method of claim 1, wherein the ground-based entity sends the at least one assigned time factor to the aircraft; and wherein the aircraft formulates the new time factors and computes the new trajectories in accordance with the assigned and additional time factors.

4. The method of claim 1, wherein the ground-based entity sends the new time factors to the aircraft; and wherein the aircraft computes the new trajectories in accordance with the new time factors.

5. The method of claim 1, wherein the new trajectory selection is also made according to present weather conditions, and near-space air traffic.

6. The method of claim 1, wherein the new trajectory selection is also made according to sensing resources of the aircraft.

7. The method of claim 1, further comprising communicating the new time factor corresponding to the selected new trajectory back to the ground-based entity.

8. The method of claim 3, further comprising negotiating at least one of the new time factors with the ground-based entity.

9. The method of claim 1, further comprising allowing for human intervention to decide whether to accept or reject the new time factor corresponding to the selected new trajectory, the decision based on the customer and flight parameters.

10. The method of claim 1, wherein the new trajectories are automatically generated in response to receipt of the at least one assigned time factor.

11. The method of claim 1, wherein the FMS is used to manage airspace of the aircraft by computing the new trajectories.

12. The method of claim 11, wherein the aircraft generates multiple sets of waypoints for flying between the current location and the destination, and selects one of the sets of the waypoints based on flight and customer parameters and performance characteristics of the aircraft.

13. The method of claim 1, wherein the at least one assigned time factor specifies a delay; and wherein the FMS selects an optimal trajectory that absorbs the delay.

14. The method of claim 1, wherein the at least one assigned time factor specifies an acceleration; and wherein the FMS computes the new trajectories in response to the at least one assigned time factor and selects an optimal one of the new trajectories for arriving at the destination ahead of schedule.

15. The method of claim 1, wherein the customer parameters include ride comfort.

16. The method of claim 1, wherein the flight parameters include fuel consumption.

* * * * *